US005572839A

United States Patent [19]

Kinsey

[11] Patent Number: 5,572,839

[45] Date of Patent: Nov. 12, 1996

[54] INTERLOCKING JAMB

[76] Inventor: Bruce F. Kinsey, P.O. Box 1936, Beaufort, S.C. 29901-1936

[21] Appl. No.: 258,735

[22] Filed: Jun. 13, 1994

[51] Int. Cl.[6] ..... E06B 3/32

[52] U.S. Cl. ..... 52/204.51; 49/175; 49/181

[58] Field of Search ..... 52/204.1, 204.51, 52/656.5, 656.6, 656.7, 208, 397, 400; 49/175, 181, 405, 435, 457

[56] References Cited

U.S. PATENT DOCUMENTS

| | | | |
|---|---|---|---|
| 2,841,834 | 7/1958 | Poole | 52/204.51 |
| 4,979,346 | 12/1990 | Pollard | 52/656.5 X |
| 5,014,466 | 5/1991 | Winner | 49/504 |
| 5,099,624 | 3/1992 | Valentin | 52/656.5 X |

FOREIGN PATENT DOCUMENTS

| | | | |
|---|---|---|---|
| 1093897 | 1/1981 | Canada | 52/204.51 |
| 9652 | 4/1980 | Germany | 52/204.51 |
| 148812 | 7/1985 | Spain | 52/204.51 |

*Primary Examiner*—Carl D. Friedman
*Assistant Examiner*—Beth A. Aubrey

[57] ABSTRACT

A sash and window frame assembly has a sash with opposite side stiles and a frame with spaced apart jambs which are fitted with the stiles by a tongue and groove interlock. This interlock which extends vertically and runs in a front to back direction of the window assembly resists inward pulling of the stile away from the jamb to which it is fitted.

5 Claims, 4 Drawing Sheets

INTERLOCKING JAMB

FIELD OF THE INVENTION

The present invention relates to a sash and frame window assembly with an interlock between the stiles of the sash and the jambs of the frame.

BACKGROUND OF THE INVENTION

A conventional window assembly comprises a window or sash surrounded by a mounting frame which fits in a wall opening. The frame comprises opposite side frame jambs and the sash has stiles which fit with the frame jambs. The jambs provide a surrounding jig or guide for the sash stiles. When a worker handles a conventional window unit, he or she may pick up by the jamb which causes an outward bowing of the jamb relative to the sash stile. This can result in the sash falling out of the frame. Although there are currently some different types of hardware fitted for example with the balance shoes which are specifically designed to provide a localized interlock between the hardware mounted on the sash and the frame, there is nothing currently available in the way of a sash stile to frame jamb interlock which would help to eliminate outward bowing of the frame relative to the sash.

Even when the frame is fitted into the window opening, the window opening itself is likely to be oversized relative to the frame to ensure that the frame can fit into the opening. A good installer must then set shims behind the jamb or use jamb adjustment clips to ensure that the jamb remains straight relative to the sash. This can be time consuming and therefore a labour expensive installation.

SUMMARY OF THE INVENTION

The present invention provides a sash and frame window assembly specifically designed to overcome the drawbacks noted above. In particular, the sash and frame window assembly of the present invention includes a sash having opposite sides stiles and the frame having spaced apart jambs which are fitted with the stiles by a tongue and groove interlock. This interlock which extends vertically and which runs in a front to back direction of the window assembly resists inward pulling of the stile away from the jamb to which it is fitted.

The sash stile to frame jamb interlock of the present invention provides a much safer handling of a window because of the greatly reduced risk of the sash falling out of the frame. Furthermore, when the window is installed in the window opening, the alignment between the frame jambs and the sashes is maintained by the interlock eliminating the need to measure and shim at specific locations along the outside of the jamb. This therefore saves substantial time in the installation process.

BRIEF DESCRIPTION OF THE DRAWINGS

The above as well as other advantages and features of the present invention will be described in greater detail according to the preferred embodiments of the present invention in which.

DETAILED DESCRIPTION ACCORDING TO THE PREFERRED EMBODIMENTS OF THE PRESENT INVENTION

Figure 1:
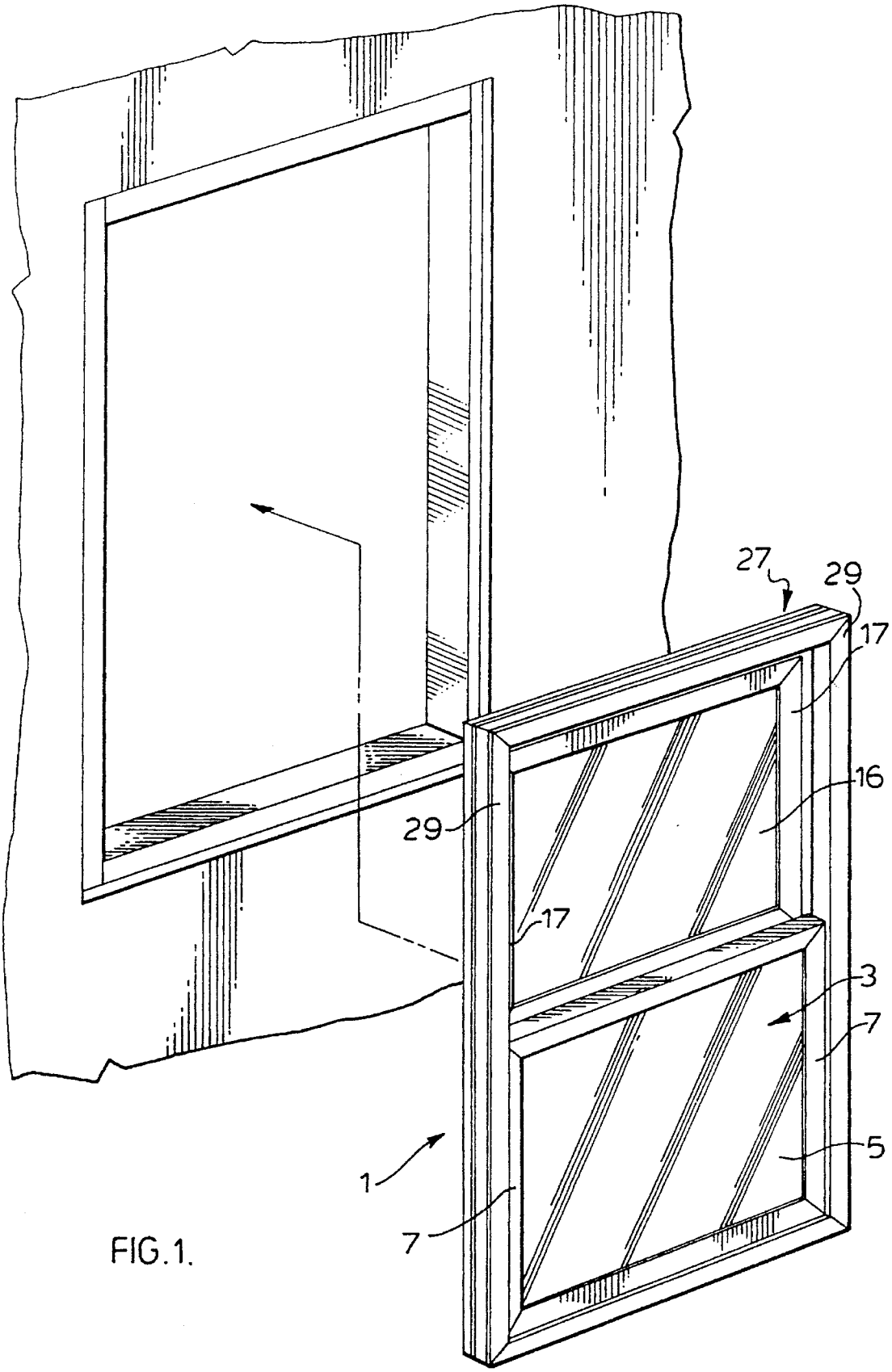
FIG. 1 is a perspective view of a window assembly in accordance with a preferred embodiment of the present invention and ready for insertion in a window opening.

FIG. 1 shows a window assembly generally indicated at 1 ready for insertion into a window opening in a wall of a building. Window assembly 1 comprises a sash generally indicated at 3 and a surrounding frame generally indicated at 27. In this particular case, the window is a double hung tilting vinyl window. It includes an inner sash 5 and an outer sash 16. The inner sash 5 includes sash stiles 7 while the outer sash includes sash stiles 17. The stiles of both of the sashes fit with the jambs 29 on opposite sides of the frame 27.

Figure 2:
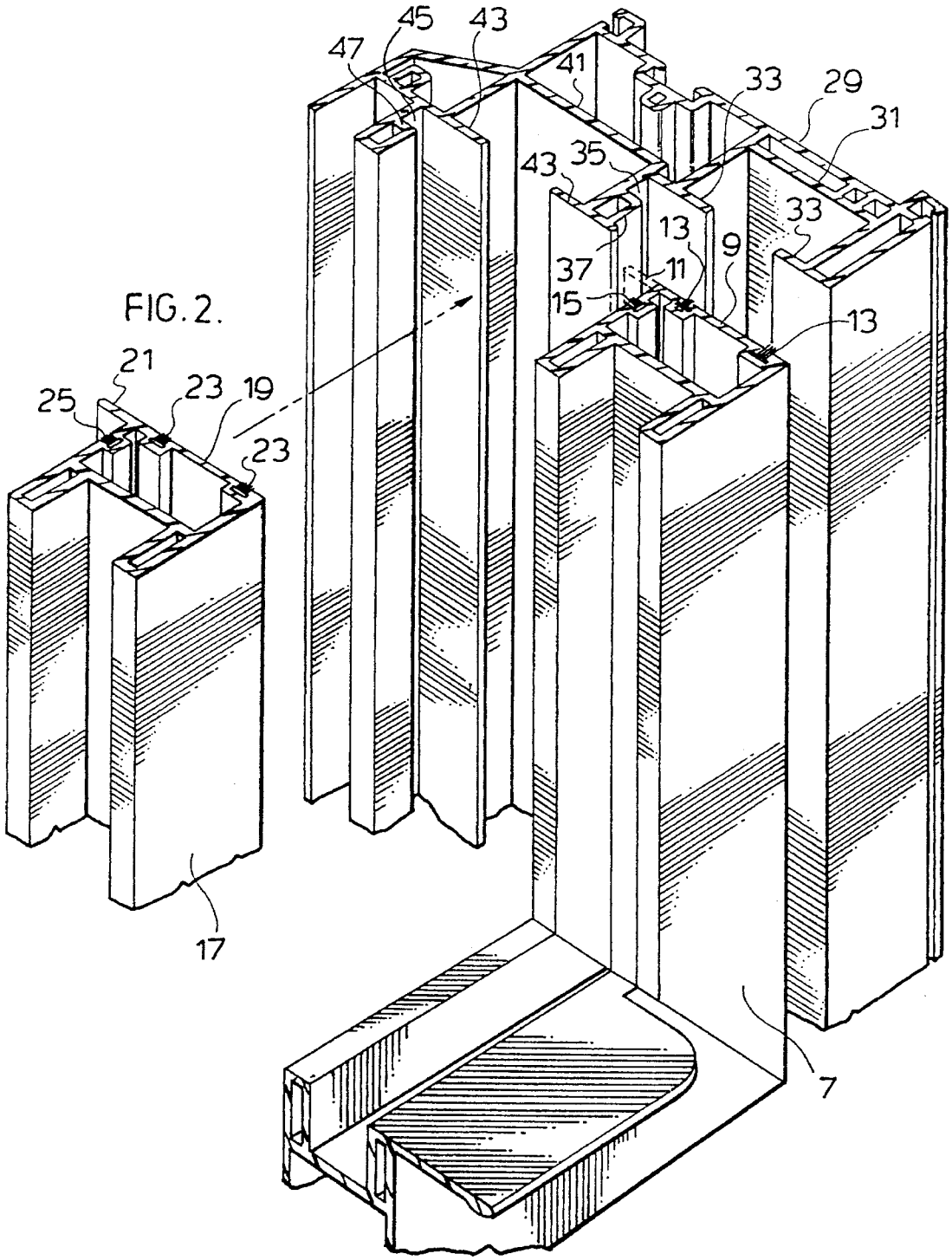
FIG. 2 is an enlarged exploded perspective view showing in section one side of the window assembly of FIG. 1.

FIG. 2 of the drawings shows details of both the sash stiles and the frame jamb. In particular, the stile 7 of sash 5, comprises an outer edge wall 9 with a rearward tongue or extension 11 along wall 9, i.e. to the side of the window which faces out of the building. As will be seen in the drawings, extension 11 runs in a front to back direction of the sash stile. It also runs vertically the full length of the stile, although it can also be set up to run along part way along the length of the stile.

As mentioned above, in this preferred embodiment both the sash and the frame are made from a relatively rigid vinyl material typical of that found in today's standard vinyl windows. Additionally provided on the sash stile are a plurality of seals made of soft weatherstripping or the like. These include seals 13 along the outer face 9 of the stile as well as a further seal 15 along the rear face of the stile.

Style 17 of sash 16 has an identical construction to stile 7. The stile 17 comprises an outside face 19 with an extension 21 extending rearwardly from the outside wall or face. A pair of seals 23 are provided along wall 19 and a further seal 25 is provided along the back or rear face of the stile.

The frame jamb 29 has a first sash stile receiving region 31 against which stile 7 is fitted and a second sash stile receiving region 41 against which sash stile 17 is fitted. The jamb region 31 includes a flat interior wall 33 which is interrupted by the hollow in the jamb as shown. Jamb region 31 further includes a jamb section 37 with a groove or recess 35 being provided between jamb section 37 and jamb wall 33.

Once again, jamb region 41 has a substantially identical construction to jamb region 31. The outside jamb region 41 includes an interrupted inside wall 43, a jamb section 47 and a recess 45 between jamb wall 43 and jam section 47.

Figure 3:
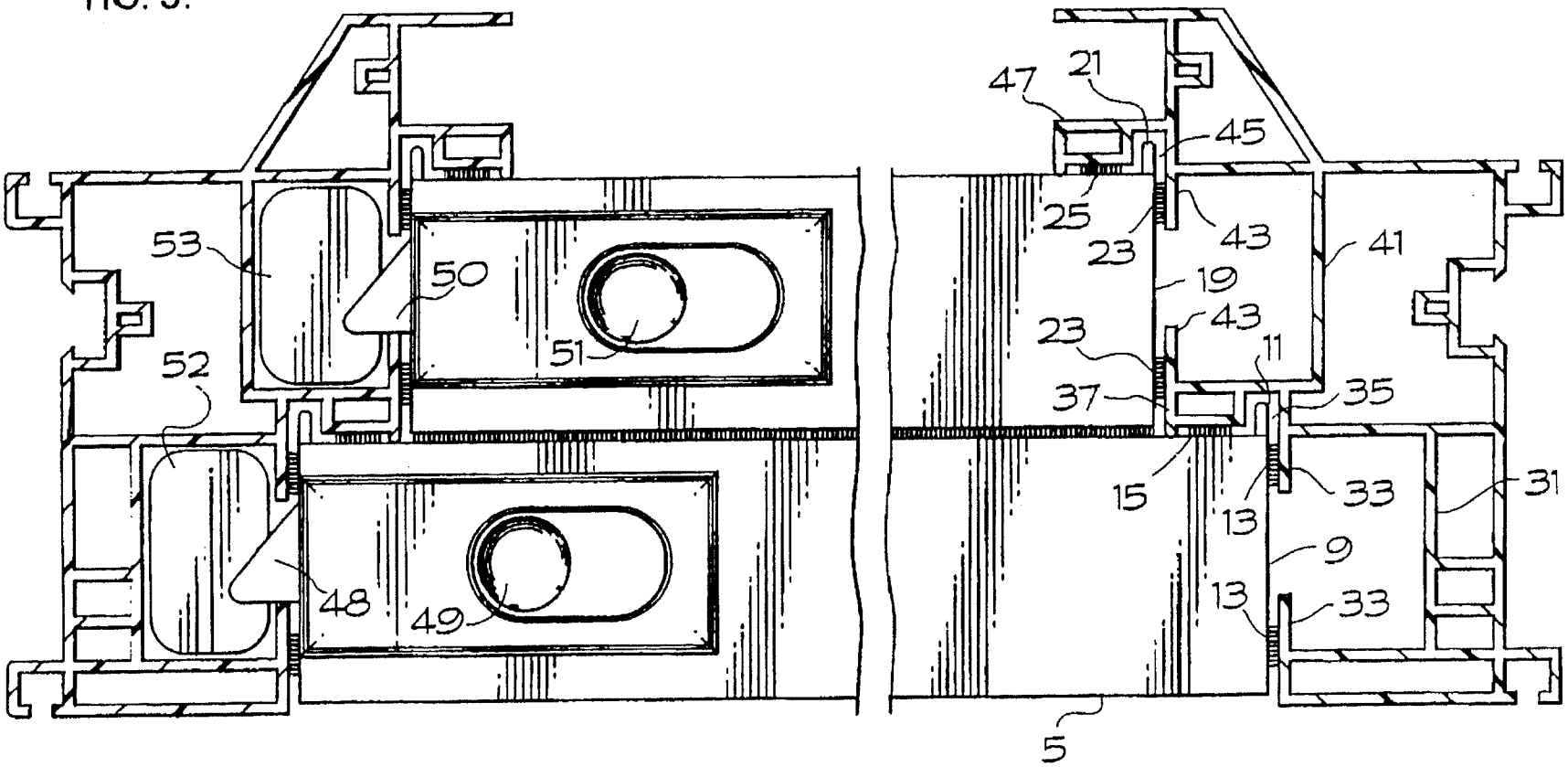
FIG. 3 is a vertical section through the window assembly of FIG. 1.

As seen in FIG. 3 of the drawings, the forward or interior sash 5 fits to the jamb region 31 with the outside wall 9 of the sash stile sealed against the jamb wall 33 by means of seals 13. The stile extension 11 fits into the recess 35 on the jamb trapped between jamb wall 33 and jamb section 37. Seal 15 seals against the front face of jamb section 37.

The sash are held securely to jamb section 37 and are prevented from falling inward by the addition of latch 48, latch operator 49 and slide-tilt mechanism 52 or other operating hardware generally available for sliding and sliding and tilting windows.

In respect of the rearward or outer sash 16, the outside wall 19 of this particular sash is sealed against the interrupted wall 43 of jamb region 41 by means of seals 23. The rearward extension 21 of the sash stile fits into recess 45 in the jamb trapped between jamb wall 43 and jamb section 47. The rearward seal 25 on the sash stile seals against the forward face of jamb section 47.

A latch 50, latch operator 51 and slide-tilt mechanism 53 or device of other design is provided to hold the sash securely against jamb section 47 preventing the sash from falling inward.

As will be apparent from the description above, as well as the arrangement of components seen in FIG. 3, the two stile extensions 11 and 21 on the forward and rearward sashes are effectively locked into the receiving recesses 35 and 45 on the frame jamb. This then provides an interlock on each of the sashes to prevent the sash stiles from pulling inwardly away from the jamb and keeps the frame squared on the sashes to ease the mounting of the window assembly.

One feature which will be clearly evident from FIG. 3 of the drawings is that because the interlock extensions 11 and 21 on the two sash frames run in a front to back direction of the window assembly, they do not in any way effect the ability of either sash to slide vertically or to tilt relative to the frame inwardly of the window opening. It is to be noted that as soon as the sashes are tilted to the closed position, the interlocks are automatically engaged. Furthermore, even when the sashes are tilted open for cleaning the window or the like, there is still some overlap along part of the length of the extension and its receiving recess on each sash stile to maintain some of the interlock. This helps guide the unfitted part of the extension back into the recess when the sash is tilted back to the closed position.

The sash stile as described above extends in a front to back direction of the window assembly. It is to be appreciated that the extension does not have to be exactly perpendicular to the window as shown but rather it could also be set at a slight angle and still provide an effective interlock.

Figure 4:
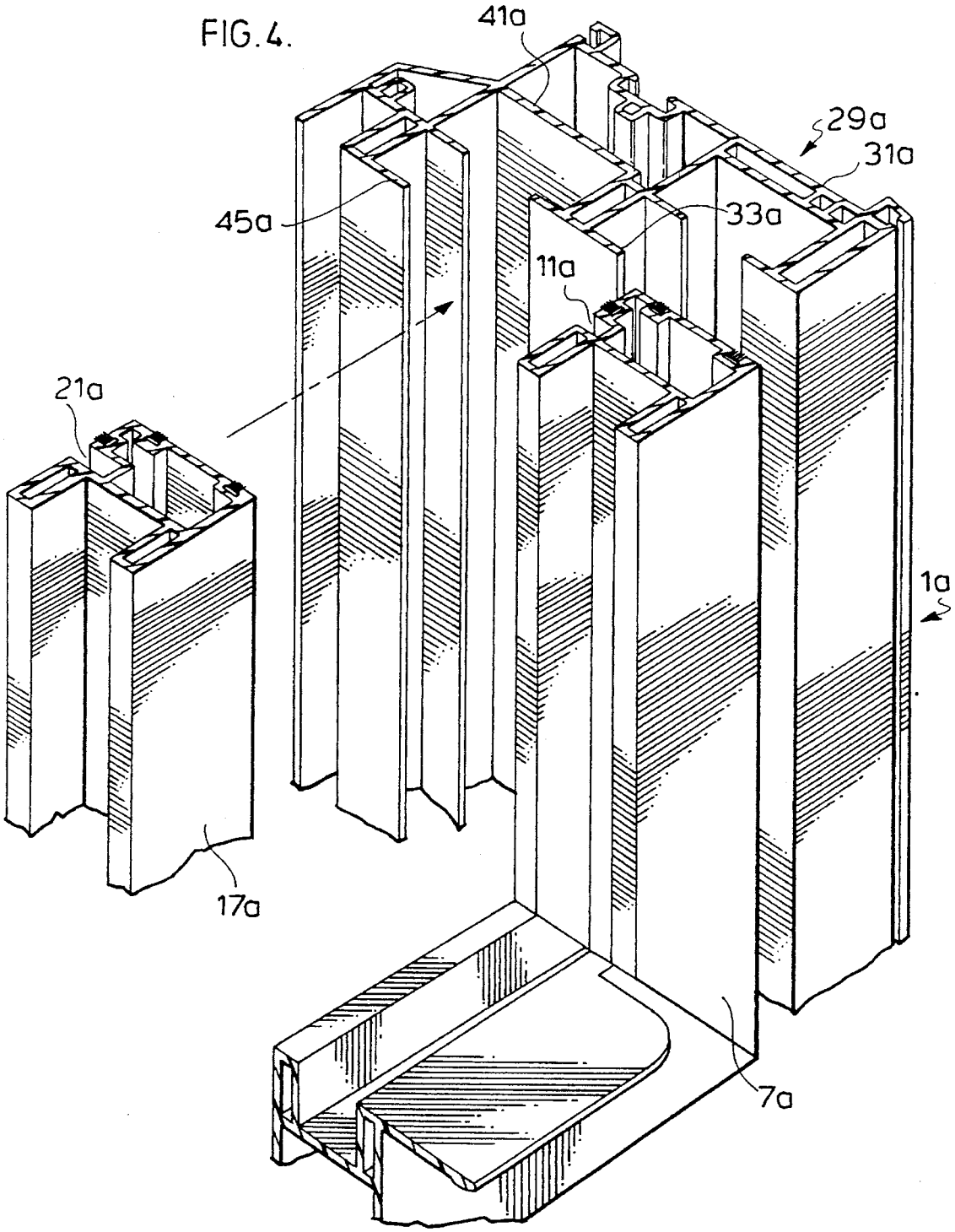
FIG. 4 is an enlarged exploded perspective view showing in section one side of a window assembly according to a further preferred embodiment of the present invention.

Another embodiment of the invention is shown in FIG. 4 of the drawings. A window assembly generally indicated at 1*a* comprises a pair of sashes having sash stiles 7*a* and 17*a*. These fit with a window frame generally indicated at 29*a*.

The forward sash stile 7*a* has a recess or groove 11*a* running down its back face. Sash stile 17*a* has a similar groove 21*a*.

Frame 29*a* has a pair of stile receiving regions 31*a* and 41*a*. Stile receiving region 31*a* includes a forwardly extending tongue or extension 33*a* while stile receiving region 41*a* includes a similar tongue 45*a*.

When the two sash stiles are fitted with the jambs of the window frame, tongue 33*a* fits within groove 11*a* of the forward sash stile while tongue 45*a* fits within the groove 21*a* on the rearward sash.

As will be appreciated from FIG. 4, the interlock between the sashes and the frame jamb is provided by the tongues on the frame jamb fitting into the grooves on the sash stiles in contrast to the reverse situation of FIGS. 1 through 3 where the tongues are provided on the sashes and the grooves are provided on the window jamb. However, what is consistent in both cases is the tongue and groove interlock extending in a front to back or at least a generally front to back direction of the window assembly.

Although specific reference has been made to a vinyl construction for the window assembly it is to be noted that the interlock can also be provided on windows made from different materials including wood, aluminum, fibreglass, etc. In all cases, the interlock is an effective guard against outward bowing of the frame relative to the sash.

A host of benefits result because of the sash stile to frame jamb interlock of the present invention. It reduces air infiltration between the sash and the jamb. The interlock blocks stray light from penetrating between the sash and the jamb. It reduces street noise by creating a baffle between the sash and the jamb. The interlock also blocks exterior dust from entering the building between the sash and the jamb.

As a result of the fact that the jamb is locked to the sash, lighter and less expensive extrusions can be used in forming a vinyl window assembly. Less reinforcement of the extrusions is required. During shipping jambs are prevented from spreading which in turn prevents the sash from falling out of the jamb. Unlike conventional windows, belly bands or shipping clips are not required.

During installation, jamb adjusters or shims are not necessary. Installation is simplified because the jamb is always correctly aligned with the sash. The installer does not need to spend time adjusting the jambs for a perfect fit.

With the interlock of the present invention security is increased. The interlock acts as a deterrent against a foreign object penetrating between the sash and the jamb.

Although various preferred embodiments of the present invention have been described herein in detail, it will be appreciated by those skilled in the art, that variations may be made thereto without departing from the spirit of the invention or the scope of the appended claims.

The embodiments of the invention in which an exclusive property or privilege is claimed are defined as follows:

1. A window comprising:

a frame, at least one sash slidable within said frame, said at least one sash having first and second side stiles, said frame having first and second opposite side jambs to which said stiles are interfitted, and a connecting means connecting the stiles and jambs, the connecting means comprising a tongue and groove, both the tongue and groove extending in a front to back direction of said window and being elongated lengthwise of said window such that the connecting means allows the stiles and jambs to slide along one another and maintain the tongue within the groove as the window is slid opened and closed.

2. A window as claimed in claim 1, wherein each said jamb has multiple jamb regions and said window has multiple sashes with said opposite side stiles of said sashes fitted with said jamb regions and each said jamb region and said stile fitted therewith having said connecting means.

3. A window as claimed in claim 1, wherein said sash is tiltable relative to said frame and when said sash is tilted part of each said tongue remains overlapped with its respective said groove.

4. A window as claimed in claim 1, wherein each of said stiles is provided with said tongue and each of said jambs is provided with said groove, the tongue extending from the rear of each of said stiles into the groove in each of said jambs.

5. A window as claimed in claim 1, wherein said stiles are provided with grooves, and said jambs are provided with tongues which fit into the grooves of said stiles.

* * * * *